United States Patent [19]

Colombo

[11] Patent Number: 4,553,360

[45] Date of Patent: Nov. 19, 1985

[54] AWNING TYPE WINDOW FRAME FOR INSTALLING EITHER RIGID GLAZING PANE OR FLEXIBLE GLAZING SHEET

[76] Inventor: Charles D. Colombo, 1238 Forsythe Dr., North Fort Myers, Fla. 33903

[21] Appl. No.: 514,527

[22] Filed: Jul. 18, 1983

[51] Int. Cl.[4] ..... E04B 1/00; A47H 13/00

[52] U.S. Cl. ..... 52/202; 160/397; 49/397; 52/773

[58] Field of Search ..... 52/202, 397, 773, 774; 49/397; 160/395, 397, 90

[56] References Cited

U.S. PATENT DOCUMENTS

| | | | |
|---|---|---|---|
| 1,022,547 | 4/1912 | Hansen | 160/395 |
| 2,612,244 | 7/1950 | Kiefer | 160/395 |
| 2,714,432 | 8/1955 | Blanchard | 52/774 |
| 2,797,778 | 7/1957 | Wagner | 49/397 |
| 2,983,002 | 5/1961 | McEvoy et al. | 52/773 |
| 3,102,579 | 9/1963 | Burton | 160/90 |
| 3,296,743 | 1/1967 | Curl | 49/397 |
| 3,392,486 | 7/1968 | Luke | 52/202 |
| 3,489,199 | 1/1970 | Weikel et al. | 160/90 |
| 4,233,790 | 11/1980 | Meadows | 52/222 |
| 4,320,609 | 3/1982 | Abell | 52/202 |
| 4,333,284 | 6/1982 | Meadows | 52/222 |

FOREIGN PATENT DOCUMENTS

| | | | |
|---|---|---|---|
| 112495 | 10/1939 | Australia | 52/774 |

*Primary Examiner*—James L. Ridgill, Jr.

*Attorney, Agent, or Firm*—Willian Brinks Olds Hofer Gilson & Lione Ltd.

[57] ABSTRACT

An awning window frame is disclosed which defines a supporting shelf positioned to support a rigid glazing pane, such as glass. The frame defines a ridge extending over the support surface in a spaced relationship thereto, and this ridge is shaped and configured to retain a beading strip. The beading strip fits between the ridge and the supporting shelf in order to conceal the junction between rigid glazing pane and the shelf. When it is desired to use the window frame with a flexible glazing sheet, such as a plastic sheet, the beading and pane are removed and the sheet is held in place on the window frame by means of a channel and spline arrangement. In some preferred embodiments, the channel is defined in the supporting shelf such that the window frame serves to support both the flexible glazing sheet and the rigid glazing pane in the same plane.

21 Claims, 12 Drawing Figures

AWNING TYPE WINDOW FRAME FOR INSTALLING EITHER RIGID GLAZING PANE OR FLEXIBLE GLAZING SHEET

BACKGROUND OF THE INVENTION

The present invention relates to awning type window frames which are pivotably mounted to a main frame to pivot between open and closed positions, and particularly to such an awning type window frame which includes means for mounting either a rigid glazing pane such as a glass pane, or a flexible glazing sheet such as a plastic sheet.

A wide variety of window frames have been proposed for mounting both glass panes and flexible glazing sheets. Abell U.S. Pat. No. 4,320,609 and Kiefer U.S. Pat. No. 2,612,244 in particular disclose fastening arrangements which can be used to mount either rigid or flexible glazing materials. In the Kiefer patent the metal bracket 17 is disclosed as supporting either a glass pane or a screen. In a somewhat similar manner, various embodiments disclosed in the Abell patent also can be used with either glass or flexible plastic glazing materials. Meadows U.S. Pat. No. 4,233,790 and U.S. Pat. No. 4,333,284 both disclose related structures utilizing a tongue-in-groove approach to holding a flexible glazing sheet in place in a storm window.

None of the systems described above is adapted for use with awning type windows of the type described in detail below. Awning type windows have specialized sealing problems as compared with fixed or sliding windows, and these sealing requirements must be taken into account in the design of an awning type window. Furthermore, none of these systems is adapted for use with a beading strip to mask the junction between a rigid glazing pane and the frame.

SUMMARY OF THE INVENTION

The present invention is directed to an improved awning type window frame which can be used to mount either a rigid glazing pane or a flexible glazing sheet, without auxiliary framing structures of any type.

According to a first feature of this invention, an awning type window frame is provided which comprises a sealing lip extending around the side and lower edges of the frame, and this sealing lip is adapted to seal the window frame to adjacent structure such as the main frame. This window frame defines a perimeter shelf which extends around a central opening of the frame, and the shelf is adapted to support a rigid glazing pane. In addition, channels are provided which extend around the frame, and these channels are adapted to receive and engage splines of the type used to mount a flexible glazing sheet in place to the frame.

In certain preferred embodiments described below, the frame defines a ridge extending parallel to the support surface, and this ridge is shaped to retain a beading strip against a glazing pane supported by the support shelf. Another feature of this invention illustrated in certain of the preferred embodiments of the drawings is that the channels are defined in the support shelf of the window frame such that the flexible glazing sheet is supported in the same plane as the rigid glazing pane. This feature of the invention allows either a flexible glazing sheet or a rigid glazing pane to be mounted in a common plane, without auxiliary framing materials. In this way, a similar appearance and configuration are provided by the frame when either rigid or flexible glazing materials are used.

The presently preferred embodiments of the window frame of this invention allow conventional beading strips to be used, yet they can easily and simply be used to secure flexible glazing sheets in place, without auxiliary frames. All of this is accomplished in a particularly simple and inexpensive manner, and frames of this invention can be extruded from materials such as aluminum in a manner substantially similar to the manner in which prior art awning type window frames are manufactured.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
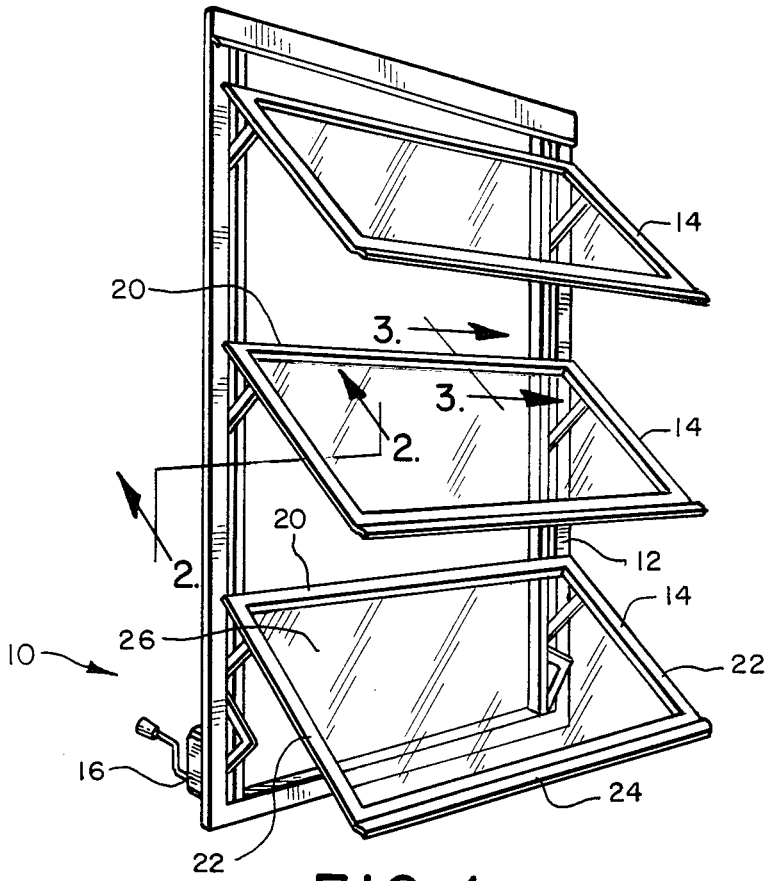
FIG. 1 is a perspective view of an awning type window which incorporates a first preferred embodiment of the window frames of the present invention.

Turning now to the drawings, FIG. 1 shows a perspective view of an awning window 10. This awning window 10 comprises a rectangular main frame 12 and a plurality of individual window frames 14. Each of these window frames 14 is pivotably mounted to the main frame 12 such that each of the window frames 14 is movable between an open position as shown in FIG. 1, and a closed position in which adjacent window frames 14 seal against one another. The pivotal position of the window frames 14 is manually controlled by a hand crank 16 which controls a linkage (not shown) to position the window frames as desired. This linkage maintains the window frames 14 in substantially parallel orientation throughout their range of travel. The main frame 12 and the hand crank assembly 16 can be formed in any one of several conventional manners, and will not be described in greater detail here.

The present invention is directed to an improved window frame 14 suitable for use in the awning window 10. This improved window frame 14 is made up of an upper frame member 20, two side frame members 22, and a lower frame member 24. These four frame members 20,22,24 are secured together so as to surround a central opening 26. Thus, the four frame members 20,22,24 cooperate to form a rigid, substantially planar window frame 14.

Figure 2:
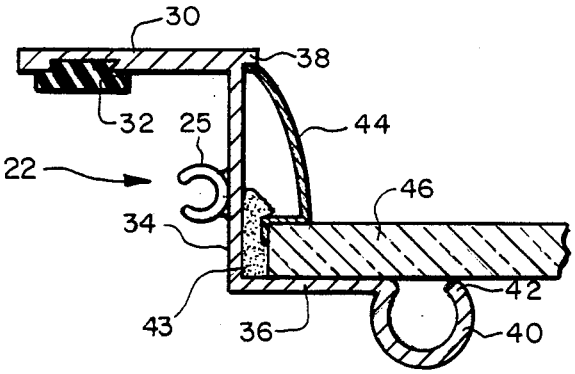
FIG. 2 is a sectional view taken along line 2—2 of FIG. 1 showing a glass pane mounted in place.
Figure 3:
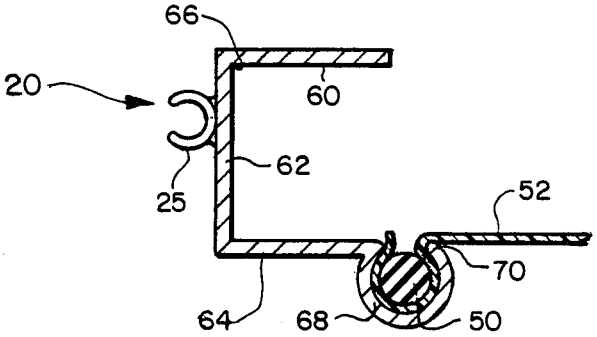
FIG. 3 is a sectional view taken along line 3—3 of FIG. 1 showing a flexible plastic sheet substituted for the glass pane.

In this embodiment, two opposed ones of the frame members 20,22,24 are notched to receive the other two of the frame members 20,22,24, and screws are used in the conventional manner to hold the frame members 20,22,24 together to form a rigid frame. As shown in FIGS. 2 and 3, the frame members 20,22,24 define screw grooves 25 shaped to receive and grip the screws which secure the frame members together.

FIG. 2 shows a sectional view through one of the side frame members 22. It should be understood that the lower frame member 24 has a cross-sectional configuration identical to that of the side frame members 22, and that the following discussion is equally applicable to the side and lower frame members 22,24.

As shown in FIG. 2, the side frame members 22 are each formed from an integral, one-piece extrusion of a material such as aluminum. The extrusion is in large part made up of three planar segments joined together in a "Z"-shaped configuration. These three segments include a sealing lip or flange 30, an intermediate wall 34, and a supporting shelf 36. As shown in FIG. 2, the sealing lip or flange 30 is oriented parallel to the supporting shelf 36 and not in overlapping configuration with the supporting shelf 36. The sealing lip 30 serves to mount a sealing gasket 32 which extends along the length of the sealing lip 30 and is preferably formed of an elastomeric material. The portion of the wall 34 adjacent to the sealing lip 30 defines a ridge 38 which extends along the length of the wall 34 parallel to and overlying a portion of the supporting shelf 36. The supporting shelf 36 defines a channel 40 extending parallel to the wall 34. This channel 40 defines a supporting lip 42 at its innermost edge. As shown in FIG. 2, the supporting lip 42 is coplanar with the surface of the supporting shelf 36.

Turning now to FIG. 3, the upper frame member 20 has a cross-sectional configuration which differs from that of the other frame members 22,24. As shown in FIG. 3, the upper frame member 20 has a substantially "C" shaped configuration. As before, the upper frame member 20 is preferably formed as a onepiece, integral extrusion of a material such as aluminum. This extrusion is in large part made up of three planar segments rigidly and integrally formed together, including a sealing lip 60, a wall 62, and a supporting shelf 64. The sealing lip 60 extends parallel to the supporting shelf 64 but in this case the sealing lip 60 is positioned to overlie a portion of the supporting shelf 64. A portion of the sealing lip 60 adjacent to the wall 62 functions as a peripheral ridge 66 to hold a beading strip 44 in place as described below. The shelf 64 defines a channel 68 near its innermost end. This channel 68 defines a supporting lip 70 which is coplanar with the surface of the shelf 64.

Figure 4:
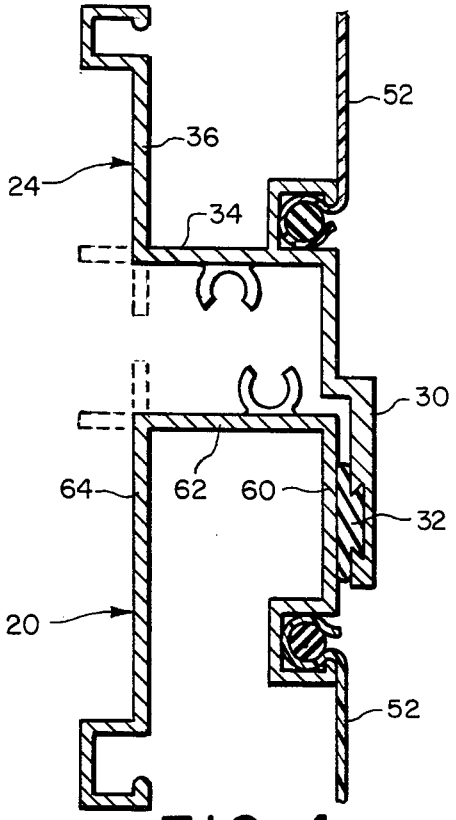
FIG. 4 is a sectional view of a second preferred embodiment showing the manner in which two adjacent window frames are configured to seal against one another when in the closed position.

When the frame members 20,22,24 are assembled together, the support shelves 36,64 are arranged to form a continuous, planar perimeter shelf extending completely around the central opening 26. Furthermore, the sealing lips 30 of the side and lower frame members 22,24 form a coplanar, three-sided sealing flange. This sealing flange is positioned to overlie portions of the main frame 12 in order to provide a substantially weather-tight seal between the window frame 14 and the main frame 12. Furthermore, the sealing lip 30 of the lower frame member 24 of an upper window frame 14 overlaps the sealing lip 60 of the upper frame member 20 of the lower adjacent window frame 14, as shown in FIG. 4. In this way, a substantially weather-tight seal is obtained between adjacent window frames 14 when they are in the closed position.

Figure 2A:
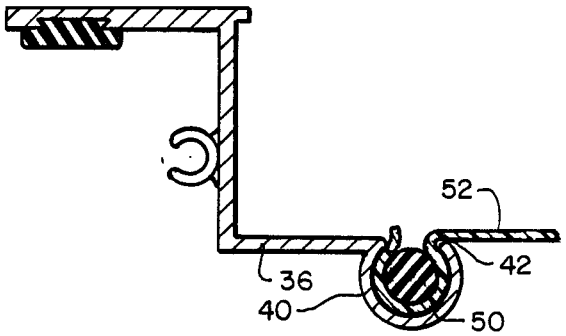
FIG. 2*a* is a sectional view corresponding to that of FIG. 2 showing a flexible plastic sheet substituted for the glass pane.

FIGS. 2 and 2*a* show the manner in which rigid and flexible glazing materials can be mounted to the frame members 22,24. As shown in FIG. 2, a putty-type glazing material 43 is used to hold a rigid glazing pane, such as a pane of glass 46, firmly against the support shelf 36, and a beading strip 44 covers the glazing material 43. This beading strip 44 is preferably a thin metal strip which is held in place by the ridge 38 of the frame members 22,24. Such beading strips 44 are conventional in the art, and therefore the window frame 14 provides the advantage of allowing the use of conventional, proven beading strips 44.

As shown in FIG. 2*a*, the same window frame 14 can be used to mount a flexible glazing sheet 52. This is done by placing the peripheral edge of the flexible glazing sheet 52 over the channel 40, and then pushing a spline 50 into the channel 40 in order to mechanically engage the spline 50 in the channel 40. In this way, the spline 50 and channel 40 cooperate to clamp the glazing sheet 52 in place. It should be noted that, since the supporting lip 42 is coplanar with the shelf 36, the window frame 14 serves to mount both the rigid glazing pane 46 and the flexible glazing sheet 52 in the same plane. Of course, when a flexible glazing sheet 52 is mounted in place as shown in FIG. 2*a*, there is no need to provide a beading strip 44 as shown in FIG. 2. The channel 40 can be shaped to receive any one of a number of commercially available splines, including flexible elastomeric and rigid plastic splines.

FIG. 3 shows the manner in which the flexible glazing sheet 52 is secured by a spline 50 and the channel 68 to the upper frame member 20. In a manner not shown, a beading strip 44 and glazing pane 46 can be mounted to the upper frame member in a manner similar to that of FIG. 2.

Figure 5A:
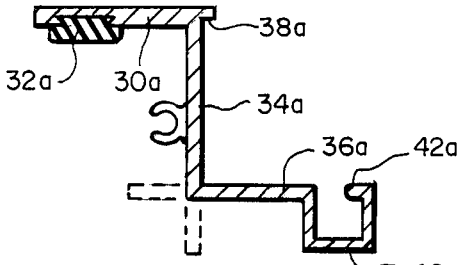
FIGS. 5*a*–5*f* are sectional views corresponding to that of FIG. 2 showing six alternate embodiments of side or bottom frame members suitable for use with this invention.
Figure 5B:
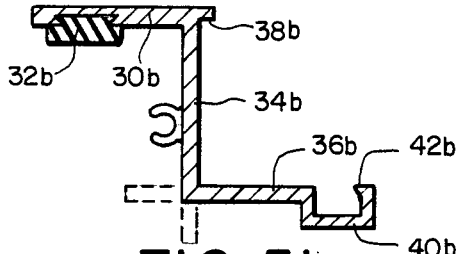
Figure 5C:
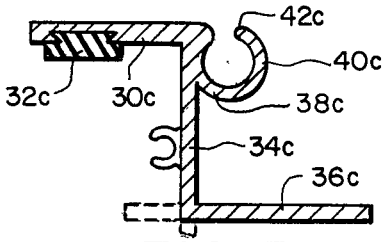
Figure 5D:
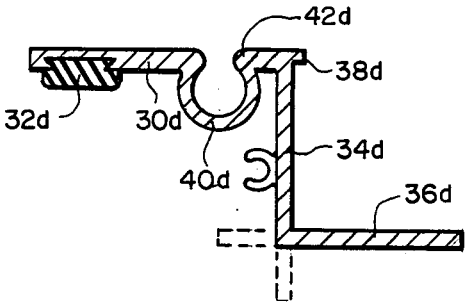
Figure 5E:
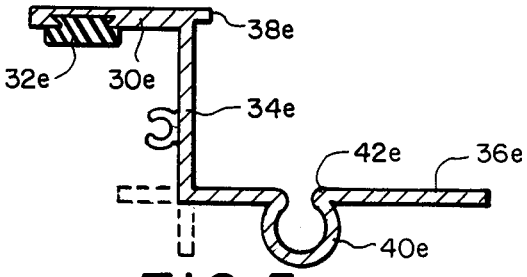
Figure 5F:
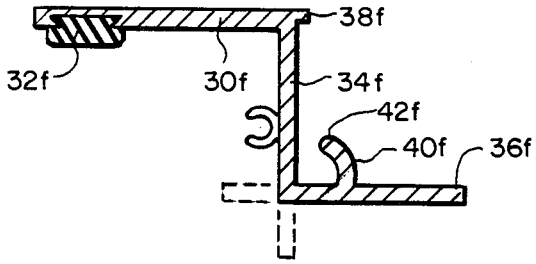
Figure 6A:
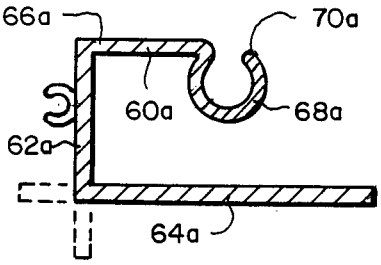
FIG. 6*a* is a sectional view corresponding to that of FIG. 3 of an alternate embodiment of an upper frame member suitable for use with this invention.

FIGS. 5*a*–5*f* and 6*a* show a number of alternative embodiments of frame members suitable for use with this invention. FIGS. 5*a*–5*f* show cross-sectional views corresponding to FIGS. 2 and 2*a* of alternative forms of the side and lower frame members 22,24. FIG. 6*a* is a cross-sectional view corresponding to FIG. 3 showing an alternative form of the upper frame member 20. In FIGS. 5*a*–6*a*, the reference numerals of FIGS. 2 and 3 are used for corresponding elements, with the exception that letters are appended to the reference numerals to indicate the alternate embodiment.

FIGS. 5*a* and 5*b* show alternate embodiments of the side or lower frame member 22,24 which are in many ways similar to the embodiment of FIG. 2. The principal difference is that in FIGS. 5*a* and 5*b* the channels 40*a* and 40*b* and the supporting lips 42*a*,42*b* are shaped somewhat differently from the corresponding portions of the structure of FIG. 2. From these figures, it should be apparent that a wide range of cross-sectional shapes can be used for the channels 40,40*a*,40*b*, depending on the shape of the spline intended for use. In a manner not shown, the channel 68 included in the upper frame member 20 can be modified in shape in a similar manner.

FIGS. 5*c*–5*f* show various alternative placements of the channel used to secure the flexible glazing sheet in place. In FIG. 5*c* the channel 40*c* is positioned on the wall 34*c* such that the supporting lip 42*c* of the channel 40*c* is coplanar with the sealing lip 30*c*. In this embodiment, the base of the channel 40*c* serves as a ridge 38*c* shaped to retain the beading strip 44 in place. In FIG. 5*d* the channel 40*d* is defined by the sealing lip 30*d* such that the supporting lip 42*d* of the channel 40*d* is coplanar with the sealing lip 30*d*. In FIG. 5*e* the channel 40*e* is defined in the supporting shelf 36*e* at an intermediate point along the width of the supporting shelf 36*e*. As in the embodiment of FIG. 2, the supporting lip 42*e* is coplanar with the supporting shelf 36*e*. FIG. 5*f* shows an alternate embodiment in which the channel 40*f* extends out of the supporting shelf 36*f* near the junction between the shelf 36*f* and the wall 34*f*. As shown in FIG. 5*f*, the supporting lip 42*f* of the channel 40*f* extends above the plane of the supporting shelf 36*f*. In a manner not illustrated, the channels 40*c*–40*f* may be provided with alternate cross-sectional shapes adapted for specific splines, such as for example the shapes shown in FIGS. 5*a* and 5*b*.

In FIGS. 4, 5*a*–5*f* and 6*a*, reinforcing ridges have been shown in dotted lines. These ridges can be used in cases where increased stiffness is needed in the frame member. As the term is used herein, the structures of the upper part of FIG. 4 and FIGS. 5*a*–5*f* all have a "Z"-shaped configuration, and the structures of the lower part of FIG. 4 and FIG. 6*a* have a "C"-shaped configuration, whether or not such ridges are present.

FIG. 6*a* shows an alternative embodiment of the upper frame member 20 shown in FIG. 3. In the alternative embodiment of FIG. 6*a* the channel 68*a* is formed in the sealing lip 60*a*, and the supporting lip 70*a* of the channel 68*a* is coplanar with the sealing lip 60*a*. The embodiment of FIG. 6*a* is well suited for use with the embodiments of 5*c* or 5*d*. Similarly, the embodiment of FIG. 5*e* is well suited for use with the embodiment of FIG. 2, and the embodiment of FIG. 5*f* is suited for use with an embodiment of the upper frame member which is not illustrated, but which includes a similarly situated channel. In the embodiment of FIG. 5*f* the beading strip 44 is shaped to overlie the channel 40*f* such that the channel 40*f* does not interfere with the operation of the beading strip.

From the foregoing, it should be apparent that a number of embodiments of an improved awning type window frame have been disclosed which can readily and simply be used to mount either rigid or flexible glazing materials. Because the window frame of this invention can readily be adapted to either glass or plastic glazing materials, a user can initially install plastic sheets in the window frames 14, and can then remove the plastic sheets and install glass panes at a later date at low additional cost. In several of the preferred embodiments, both the rigid and the flexible glazing materials are mounted in the same plane, and in no case is an auxiliary frame or the like needed to adapt the window frame to either glazing material. The window frames of this invention can readily be fabricated using the same extrusion techniques as those used in the past for prior art awning window frames which do not have the flexibility of the present invention.

Of course, it should be understood that a wide range of changes and modifications to the preferred embodiments described above will be apparent to those skilled in the art. For example, the present invention can be adapted for use in window frames having differing cross-sectional configurations. It is, therefore, intended that the foregoing detailed description be regarded as illustrative rather than limiting, and that it be understood that it is the following claims, including all equivalents, which are intended to define the scope of this invention.

I claim:

1. An awning window frame adapted alternately to support a rigid glazing pane and to cooperate with at least one spline to support a flexible glazing sheet, said frame comprising:

a generally C-shaped upper frame member defining an upper support shelf and an upper sealing lip, spaced from and overlying the upper support shelf;

two generally Z-shaped side frame members, each defining a respective side support shelf and a respective side sealing lip;

a generally Z-shaped lower frame member defining a lower support shelf and a lower sealing lip;

said side frame members secured to the upper and lower frame members to surround a central opening, such that the side support shelves are aligned with the upper and lower support shelves to form a perimeter shelf adapted to contact and suport a perimeter portion of said rigid glazing pane, and the lower sealing lip is aligned with the side sealing lips to form a perimeter sealing lip, extending around outside portions of the side and lower frame members, adapted to seal the side and lower frame members to an adjacent structure;

each of said frame members further comprising means for defining a channel extending parallel to the respective glazing shelf such that said channels extend substantially around the perimeter shelf, each of said channels sized to receive and engage said at least one spline and a peripheral portion of the flexible glazing sheet to secure said flexible glazing sheet to the frame members, each of said channels defining a spline-retaining wall extending transversely to the respective glazing shelf to prevent movement of the spline toward the central opening.

2. The invention of claim 1 wherein each of the channels is defined by the respective peripheral shelf and each of the channels defines a respective supporting lip positioned to support the flexible glazing sheet, wherein each of the supporting lips is coplanar with the perimeter shelf.

3. The invention of claim 1 further comprising means, included in the frame members, for defining a peripheral ridge extending around the central opening, spaced from and parallel to the perimeter shelf, said peripheral ridge situated and shaped to retain a beading strip in place against the rigid glazing pane.

4. The invention of claim 1 wherein the channels are sized to receive both the spline and a portion of the flexible glazing sheet wrapped around the spline in order to clamp the flexible glazing sheet positively in position between the spline and the frame members.

5. The invention of claim 1 wherein each of the channels defines an opening and wherein the opening is narrower than an interior portion of the channel in order to oppose movement of the spline out of the channel.

6. The invention of claim 1 wherein the flexible glazing sheet extends across the central opening and over the channel in each of the frame members, and wherein the at least one spline is positioned within the channels such that the flexible glazing sheet is wrapped around a part of the at least one spline and the flexible glazing sheet is clamped in place between the at least one spline and the frame members.

7. The invention of claim 6 wherein each of the channels defines an opening and wherein the opening is narrower than an interior portion of the channel in order to oppose movement of the spline out of the channel.

8. The invention of claim 1 wherein the frame members are formed of an extruded material.

9. The invention of claim 8 wherein the material is aluminum.

10. The invention of claim 1 wherein each of the channels defines a supporting lip positioned to support the flexible glazing sheet, and wherein each of the supporting lips is planar and spaced from the plane of the perimeter shelf.

11. The invention of claim 10 wherein the supporting lip of each of the channels is coplanar with the respective sealing lip.

12. The invention of claim 11 wherein the channel of each of the side and lower frame members is positioned at an inner peripheral edge of the respective sealing lip.

13. An awning window frame adapted alternately to support a rigid glazing pane and to cooperate with a spline to support a flexible glazing sheet, said frame comprising:

a perimeter frame defining a central opening and an outer sealing flange which extends around a lower outside portion of the frame;

means, included in the frame, for defining a planar support shelf extending around the central opening to support an outer perimeter portion of said rigid glazing pane; and means, included in the frame, for defining a perimeter channel in the support shelf around the central opening, said channel shaped to retain said spline to clamp said flexible glazing sheet in place in the frame in the plane of the perimeter shelf, said perimeter channel defined in part by a spline-retaining wall extending transversely to the support shelf to oppose movement of the spline toward the central opening.

14. The invention of claim 13 further comprising means, included in the frame, for defining a ridge extending around the central opening, spaced from and parallel to the support shelf, said ridge shaped and positioned to retain a beading strip in place against the rigid glazing pane.

15. The invention of claim 13 wherein the frame is formed of extruded aluminum.

16. The invention of claim 13 wherein the frame comprises a lower frame member and two side frame members having a first cross-sectional configuration adapted to extend outwardly from the support shelf to define the sealng flange and seal against the adjacent structure, and an upper frame member having a second cross-sectional configuration different from the first configuration.

17. The invention of claim 13 wherein the flexible glazing sheet extends across the central opening and over the perimeter channel, and wherein the spline is positioned within the perimeter channel to secure the flexible glazing sheet in place between the spline and the perimeter frame.

18. An awning window frame for alternately supporting a rigid glazing pane and cooperating with a spline to support a flexible glazing sheet, said frame comprising:

a three-sided frame formed of two side frame members and a lower frame member, each of said side and lower frame members comprising a one-piece, integral structure which defines an outer sealing flange, an inner support shelf, and a wall interconnecting the flange and the shelf such that the flange and shelf are oriented parallel to one another in nonoverlapping relationship;

an upper frame member secured to the three-sided frame between the side frame members to enclose a central opening with the three-sided frame, said upper frame member comprising a one-piece, integral structure which defines:

an upper support shelf extending between and coplanar with the support shelves of the side frame members such that the support shelves of the four frame members form a planar, continuous perimeter shelf extending around the central opening;

an upper sealing flange; and an upper wall interconnecting the upper sealing flange to the upper support shelf such that the upper sealing flange is parallel to and overlies the upper support shelf; means, included in the one-piece, integral frame members for defining a channel in the perimeter shelf which extends substantially around the central opening, said channel shaped to receive and retain said spline to mechanically secure said flexible glazing sheet in place such that the glazing sheet extends across the central opening, said channel defined in part by a spline-retaining wall oriented transversely to the perimeter shelf to oppose movement of the spline toward the central opening; and means, included in the one-piece, integral frame members for defining a perimeter ridge extending around the walls of the frame members, spaced from and parallel to the respective support shelves, said ridge shaped to retain a beading strip in place against said rigid glazing pane secured to the perimeter shelf such that the beading strip is captured between the glazing pane and the perimeter shelf.

19. The invention of claim 18 wherein the flexible glazing sheet extends across the central opening and over the channel, and wherein the spline is positioned within the channel such that the flexible glazing sheet is partially wrapped around the spline and the flexible glazing sheet is wedged in place between the spline and the perimeter shelf.

20. The invention of claim 18 wherein the channel defining means is situated such that a perimeter surface of the flexible sheet is coplanar with the perimeter shelf.

21. The invention of claim 18 wherein the channel defining means comprises an upper channel defined by the upper sealing flange, and three lower channels each disposed at the junction between the outer sealing flange and the wall of a respective one of the side and lower frame members.

* * * * *